US010294611B2

(12) United States Patent
Eryilmaz et al.

(10) Patent No.: US 10,294,611 B2
(45) Date of Patent: May 21, 2019

(54) PROCESS OF PREPARING A DYED FABRIC INCLUDING A BACTERIAL BIOPOLYMER AND HAVING UNIQUE APPEARANCE

(71) Applicant: Sanko Tekstil Isletmeleri San. Ve Tic. A.S., Inegol-Bursa (TR)

(72) Inventors: Jitka Eryilmaz, Inegol-Bursa (TR); Onur Yukselen, Inegol-Bursa (TR); Ozgur Cobanoglu, Inegol-Bursa (TR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 0 days.

(21) Appl. No.: 15/479,884

(22) Filed: Apr. 5, 2017

(65) Prior Publication Data

US 2017/0314193 A1 Nov. 2, 2017

(30) Foreign Application Priority Data

Apr. 27, 2016 (EP) ..... 16167312
Apr. 27, 2016 (EP) ..... 16167320

(51) Int. Cl.
*D06M 15/05* (2006.01)
*D06P 1/22* (2006.01)
(Continued)

(52) U.S. Cl.
CPC ..... *D06P 1/228* (2013.01); *D03D 13/004* (2013.01); *D03D 13/008* (2013.01); *D03D 15/08* (2013.01); *D03D 27/00* (2013.01); *D06M 15/05* (2013.01); *D06M 15/11* (2013.01); *D06M 15/15* (2013.01); *D06M 16/003* (2013.01); *D06M 23/06* (2013.01); *D06N 3/0006* (2013.01); *D06N 3/009* (2013.01); *D06N 3/0015* (2013.01);
(Continued)

(58) Field of Classification Search
CPC .... D06M 16/003; D06M 15/05; D06M 23/06; D06P 1/0052; D06P 1/50; D03D 23/00; D03D 25/00; D03D 17/00
See application file for complete search history.

(56) References Cited

U.S. PATENT DOCUMENTS

2012/0082712 A1 4/2012 Stopek et al.
2013/0000057 A1* 1/2013 Schoots ..... D06P 1/22 8/494

FOREIGN PATENT DOCUMENTS

WO 2008020187 2/2008
WO 2010052585 5/2010

OTHER PUBLICATIONS

International Search Report and written opinion dated Jul. 25, 2017 for of PCT/EP2017/059477.
(Continued)

*Primary Examiner* — Eisa B Elhilo
(74) *Attorney, Agent, or Firm* — Silvia Salvadori

(57) ABSTRACT

The present invention provides a process for the production of a fabric having a unique appearance and the fabric so obtained. Also provided is the clothing articles, i.e. garments, including the fabric. More particularly, the present invention relates to a process for producing a woven fabric having a unique, e.g. "used" (i.e. worn-out) or "multi-shaded" appearance and the process includes a step of providing a woven fabric with a layer of bacterial biopolymer, dyeing at least part of the fabric together with the biopolymer layer, and then removing at least part of the bacterial biopolymer layer from the fabric.

21 Claims, 11 Drawing Sheets

(51) Int. Cl.

| | |
|---|---|
| ***D06M 15/11*** | (2006.01) |
| ***D06M 15/15*** | (2006.01) |
| ***D06M 16/00*** | (2006.01) |
| ***D06M 23/06*** | (2006.01) |
| ***D06N 3/00*** | (2006.01) |
| ***D06N 3/12*** | (2006.01) |
| ***D03D 13/00*** | (2006.01) |
| ***D03D 15/08*** | (2006.01) |
| ***D06N 3/02*** | (2006.01) |
| ***D03D 27/00*** | (2006.01) |
| ***D06P 5/12*** | (2006.01) |
| ***D06P 1/46*** | (2006.01) |
| ***D06P 1/48*** | (2006.01) |
| ***D06P 1/50*** | (2006.01) |
| *D06M 101/06* | (2006.01) |
| *D06P 3/60* | (2006.01) |

(52) U.S. Cl.

CPC ..... *D06N 3/0088* (2013.01); *D06N 3/02* (2013.01); *D06N 3/12* (2013.01); *D06P 1/46* (2013.01); *D06P 1/48* (2013.01); *D06P 1/50* (2013.01); *D06P 5/12* (2013.01); *D03D 2700/0103* (2013.01); *D03D 2700/0137* (2013.01); *D06M 2101/06* (2013.01); *D06N 2201/042* (2013.01); *D06N 2203/026* (2013.01); *D06N 2203/028* (2013.01); *D06N 2209/1635* (2013.01); *D06N 2211/10* (2013.01); *D06P 3/6025* (2013.01); *D10B 2201/02* (2013.01); *D10B 2501/00* (2013.01)

(56) References Cited

OTHER PUBLICATIONS

International Search Report of PCT/EP2017/059471 dated Jul. 25, 2017.

Database WPI Week 199802 Thomson Scientific, London, GB; AN 1998-051342 & JP H09 279483 A (Unitaka Ltd) Oct. 28, 1997.

European Search Report and written opinion of priority application No. 16167320.7 dated Oct. 12, 2016.

European Search Report and written opinion of priority application No. 16167312.4 dated Oct. 11, 2016.

International Preliminary Report on Patentability dated Nov. 8, 2018 for corresponding International patent application No. PCT/EP2017/059471.

* cited by examiner

PROCESS OF PREPARING A DYED FABRIC INCLUDING A BACTERIAL BIOPOLYMER AND HAVING UNIQUE APPEARANCE

RELATED APPLICATION

This application claims priority to European Application EP16167320.7 filed Apr. 27, 2016, and titled "A Process of Preparing a Dyed Fabric Including a Bacterial Biopolymer and Having Unique Appearance," and also claims priority to European Application EP16167312.4 filed Apr. 27, 2016, and titled "Composite Fabric Comprising A Bacterial Biopolymer Layer", the contents of each of which are hereby incorporated by reference herein, as if set forth in their entirety entireties.

TECHNICAL FIELD

The present invention relates to a process for the production of a fabric having a unique appearance, to a fabric obtained with said process and to clothing articles, i.e. garments, including said fabric. In particular, the present invention relates to a process for producing a woven fabric having a unique, e.g. "used" (i.e. worn-out) or "multi-shaded" appearance, wherein said process comprises the use of a bacterial biopolymer.

BACKGROUND

Worn out fabrics, especially denim, have enjoyed popularity in fashion industry due in particular to the finishing processes that can be applied to the fabric in order to create different appearances and thus different visible effects on the front side of the fabric, i.e. on the surface that is visible when the article made by the fabric is worn. In fact, the success in denim industry largely depends on creativity coming from a variety of fabric finishing processes that gives fabrics unique appearances.

The exterior appearance of a fabric, and thus of a clothing article made by the fabric, can be modified by using different finishing techniques.

A "used" or "vintage" or "worn-out" look of the fabric can be achieved by treating the fabric with a finishing process that is generally carried out on the garment or on the fabric. The known finishing processes may use specific chemicals, or mechanical abrasion, such as processes using stone-washing, acid wash, laser treatment and sandblasting. For example, in the stone washing, the fabric is washed in a cylinder in the presence of pumice stones. While the wash cylinder rotates, the fabric is contacted by the stones that will remove part of the yarn fibers including the dye present on said fibers.

In this case, when a fabric and, in particular, an indigo dyed woven fabric is used, wherein the indigo dye is located on the surface of the yarns leaving the core of the yarns undyed, a stone wash (or sand blast) finishing process can be applied to allow varying amounts of the undyed cores of the indigo yarns to become visible.

These different finishing treatments result in different visible effects, in particular worn-out appearance, which make the fabric fashionable in the clothing and textile industries. However, the visible effects and appearance that are obtainable by the known finishing treatments, are limited. Therefore, garments made by different producers are often similar one to another, thus reducing the commercial desirability of the product and the possibility to distinguish a product from those of another producer.

A further disadvantage of traditional stone washing is that the stones can damage the fabric.

SUMMARY

It is an aim of the present invention to solve the above mentioned problems and to provide a process for the production of a fabric having a "unique" appearance; with "unique appearance" it is here meant an appearance different from the known ones, i.e. a look that was previously not attainable with known finishing processes, such as an improved "used" or "vintage" or "worn-out" appearance, in particular a distinctive worn-out appearance previously not obtainable with known processes.

Another aim of the present invention, is to provide a process for the production of a fabric having a "unique" appearance which is commercially desirable, recognizable and readily distinguishable from other products.

Still another aim of the present invention is to provide a process wherein damage to the yarns and the fabric made thereof is substantially avoided or is reduced, during the manufacturing and finishing processes. A further aim of the invention is to provide a finishing process that avoids or reduce the environmental costs of known finishing processes and that is less expensive than said processes.

These and other aims are achieved by a process for producing a treated fabric, which results in the production of a treated fabric, the fabric suitable for the manufacture of a garment.

In particular, the present invention refers to a process for producing a fabric, comprising the following steps:

a. Providing at least one plurality of warp yarns and at least one plurality of weft yarns;
b. Weaving said at least one plurality of warp yarns with said at least one plurality of weft yarns to provide a woven fabric, having a front side and a back side;
c. Providing at least a layer of at least one bacterial biopolymer on said yarns or on at least part of at least one side of said woven fabric to provide a composite fabric;
d. Dyeing at least part of said composite fabric, whereby at least part of the fabric yarns are dyed together with said biopolymer layer;
e. Removing at least part of said layer of bacterial biopolymer from said composite fabric to obtain a treated fabric.

Various embodiments are recited in the claims.

In one embodiment, after step d and before step e the fabric is made, i.e. it is tailored, into a garment; the finishing processes may be applied to the fabric or to the garment including the fabric. In the following description reference will be made to the "fabric" to also identify a garment as far as at least the finishing processes are concerned, without limiting the scope of protection to treatment of the fabric only. As a matter of fact, the process of claim 1 may be carried out on a garment; claim 1 thus encompasses the treatment of a fabric in a garment.

By means of a process according to the invention, a "treated fabric", i.e. a woven fabric after finishing processes, with an improved (i.e. a "unique") aesthetical effect, can be obtained. The obtained fabric, i.e. the "treated" fabric, presents a "multi-shaded" effect, namely a "multi-shaded" appearance, previously not available through known finishing processes. Specifically, the obtained "multi-shaded" effect, is a distinctive appearance, preferably a "used" or "worn-out" appearance, which comprises a plurality of shades of color, which are distributed throughout the fabric (and, thus, throughout a garment comprising it) according to a non-reproducible distribution, such that the same distribution of shades cannot be reproduced from a fabric to another.

Without being bound to a specific scientific explanation, a possible explanation is that a bacterial biopolymer layer, being produced by living microorganisms, may not be structurally identical to another bacterial biopolymer layer, even if it has been produced by the same microorganisms and in the same conditions.

Therefore, it has been observed that two different bacterial biopolymer layers provide for two different dyeing-results of the bacterial biopolymer layers themselves and of the fabrics (or yarns) coupled therewith, as well.

As above mentioned, by means of a process according to the invention a "treated fabric", i.e. a woven fabric after finishing processes, with a "unique" aesthetical effect, can be obtained; in other words, two woven fabrics that are "treated" with the disclosed process, show two different aesthetical results, i.e. the same distribution of color shades is not reproduced from a fabric to another. Thus, each "treated fabric", obtained by the process of the invention, shows an aesthetical appearance that is substantially "unique", i.e. an aesthetical appearance that is substantially "not reproducible".

The treated fabric of the invention, as obtained after the removal of at least part of the bacterial biopolymer layer from the dyed composite fabric, shows a plurality of color shades, according to the amount of dye which has been absorbed by the bacterial biopolymer layer and reached the underlying woven fabric.

This is particularly true when, according to various embodiments, said at least one bacterial biopolymer layer has a thickness "T" that is non-uniform throughout the extension of the bacterial biopolymer layer, i.e. that is not the same throughout the whole extension of the bacterial biopolymer layer.

In fact, without being bound to a specific scientific explanation, it has been observed that the dye uptake of the fabric provided with the claimed bacterial biopolymer layer as obtained in step c of the process of the invention, is variable in relationship with the variable thickness of the bacterial biopolymer layer.

In particular, it has been observed that, the higher is the thickness T, the higher is the dye uptake of the layer of bacterial biopolymer, i.e., the amount of dye which is absorbed by the bacterial biopolymer layer, and the less is the amount of dye that arrives to the yarns and that dyes the yarns provided with the biopolymer layer. In other words, when, for example, a composite fabric comprises a bacterial biopolymer layer having non-uniform (i.e. "variable") thickness, different amounts of dye reach the underlying surface (for example, the front side) of the woven fabric, according to the thickness of the bacterial biopolymer layer so that the fabric yarns take on different amounts of dye in different regions.

It has to be noted that the thickness ("T") of the bacterial biopolymer layer of a composite fabric according to the invention and the amount of the dye which reaches the woven fabric provided with the biopolymer layer are inversely proportional. In other words, the higher is the thickness of the bacterial biopolymer layer, the lower is the amount of dye that reaches the woven fabric provided with the biopolymer layer. For example, if the thickness of the bacterial biopolymer layer of a composite fabric according to the invention is high, a high amount of dye is absorbed by the bacterial biopolymer layer and only a low amount of dye (or none) reaches the woven fabric provided with the biopolymer layer. Therefore, after the removal of the bacterial biopolymer layer, a treated fabric that is slightly colored (i.e. that is a colored in a light shade of color) or that is substantially non-colored is obtained.

On the contrary, for example, if the thickness "T" of the bacterial biopolymer layer is low, a low amount of dye is absorbed by the bacterial biopolymer layer, and thus a high amount of dye reaches the surface (i.e., for example, the front side) of the woven fabric provided with the biopolymer layer. Therefore, after the removal of the bacterial biopolymer layer, a treated fabric that is intensely colored (i.e. that is colored in a dark shade of color) is obtained.

As used herein, the term "thickness", refers to the distance between the top and bottom or front and back surfaces of something; e.g., the distance between the top and bottom surfaces of the bacterial biopolymer layer. The bottom surface of the bacterial biopolymer layer is the surface of the bacterial biopolymer layer which contacts the fabric or yarns. The top surface of the bacterial biopolymer layer is the surface of the bacterial biopolymer layer, opposite to the bottom surface, which does not contact the fabric or yarns.

As used herein, the term "uniform thickness", refers to a thickness that is substantially constant (substantially non-variable); e.g. the distance between the top and bottom surfaces of the bacterial biopolymer layer does not substantially change along the extension of the bacterial biopolymer layer.

On the contrary, as used herein, the term "non-uniform thickness", refers to a thickness that is variable; e.g. the distance between the top and bottom surfaces of the bacterial biopolymer layer varies (i.e. "changes", i.e. it is not constant) along the extension of the bacterial biopolymer layer.

According to some embodiments, at least part of said bacterial biopolymer layer is a discontinuous layer.

For example, a bacterial biopolymer layer can be a discontinuous biopolymer layer, i.e. a bacterial biopolymer layer can have interruptions along its extension. In this case, for example, a fabric or a yarn that is provided with a discontinuous biopolymer layer presents regions on its surface (e.g. the front side of a woven fabric) that are not "covered" by the bacterial biopolymer layer.

Advantageously, considering, for example, a composite fabric (as obtainable in step c of the process of the invention) wherein the bacterial biopolymer layer is discontinuous, i.e. wherein the bacterial biopolymer layer presents interruptions throughout its extension, regions of the woven fabric provided with bacterial biopolymer layer, result to be "not-covered" by the biopolymer layer. Therefore, when the composite fabric is dyed according to step d of the process of the invention, regions of the woven fabric that are "not-covered" by the biopolymer layer are completely and "directly" dyed; in other words, where the woven fabric is not "covered" by the biopolymer layer, the dye is applied directly on the woven fabric.

Advantageously, when a composite fabric comprises a discontinuous bacterial biopolymer layer, a treated fabric having a patterned multi-shaded effect can be obtained.

In other words, a discontinuous bacterial biopolymer layer according to the invention can present a predetermined "patterned" distribution of "interruptions" in order to provide a treated fabric with a predetermined pattern of regions of the woven fabric that are "completely" and "directly" dyed, as above mentioned. Therefore, once the bacterial biopolymer layer is removed according to step e of the process of the invention, a treated fabric having a multi-shaded effect further comprising a patterned distribution of "completely dyed" regions can be obtained. On the contrary, where the woven fabric is provided with the bacterial biopolymer layer, once the bacterial biopolymer layer is removed after the dyeing, regions having multi-shaded effect, as above defined, are obtained. In other words, the bacterial biopolymer layer can act as a "stencil" when the composite fabric is dyed.

According to embodiments of the invention, variation within the weaving pattern of the woven fabric provides further visual effects. In fact, it has been observed that the weaving pattern contributes to the final appearance.

According to one embodiment, the bacterial biopolymer layer is a non-uniform discontinuous layer. In other words, a bacterial biopolymer according to the invention can have a variable thickness and interruptions throughout its whole extension.

According to embodiments of the invention, the woven fabric is provided with at least one bacterial biopolymer layer on at least the front side and/or the back side.

As used herein, the term "front side" of the fabric, refers to the side of the fabric which is the external visible side when a garment comprising the fabric is worn. As used herein, the term "back side" of the fabric, refers to the side of the fabric which is the internal not visible side when a garment comprising the fabric is worn.

According to embodiments, the woven fabric is provided with at least one bacterial biopolymer layer on both the front side and the back side.

For example, a woven fabric according to the invention can be provided with two bacterial biopolymer layers, namely with a first biopolymer layer on its front side and with a second biopolymer layer on its back side, thus providing a composite fabric comprising a woven fabric and two bacterial biopolymer layers.

According to exemplary embodiments, the first biopolymer layer (on the front side) and the second biopolymer layer (on the back side) can comprise the same or a different bacterial biopolymer.

As used herein, the terms "bacterial biopolymer layer", "bacterial polymer layer", "biopolymer layer" and "polymer layer" refer to a layer comprising at least one bacterial biopolymer.

As used herein, the terms "bacterial biopolymer" and "bacterial polymer" refers to all the polymers the can be produced by a microorganism, where the term "microorganism" encompasses not genetically modified (i.e. wild type) microorganisms and genetically modified microorganism. For example, a microorganism can be genetically modified in order to produce a bacterial biopolymer which is not produced by the same microorganism when it is not genetically modified (i.e., when it is a wild type microorganism).

As used herein, the term "microorganism" refers to small unicellular or multicellular living organisms that are too small to be seen with naked eye but are visible under a microscope, and encompasses bacteria, yeast, fungi, viruses and algae. As above mentioned, the term "microorganism" encompasses not genetically modified (i.e. wild type) microorganisms and genetically modified microorganism as well.

In the present description, reference is made to "bacterial biopolymer" for sake of simplicity, without however limiting the scope of the invention to polymers produced by "bacteria" only, but encompassing all the polymers the can be produced by a microorganism as above defined.

According to embodiments of the invention, the bacterial biopolymer layer comprises a sugar-based biopolymer or an amino acid-based biopolymer or a mixture thereof.

As used in the present description, the term "sugar-based biopolymer" encompasses linear and branched polysaccharides, variants and derivatives thereof. One example of sugar-based biopolymer is bacterial cellulose.

As used in the present description, the term "amino-acid based biopolymer" encompasses linear and branched polypeptides, variants and derivatives thereof. One example of an amino acid-based biopolymer, is bacterial collagen.

According to various embodiments, the bacterial biopolymer is selected from bacterial cellulose, bacterial collagen or mixtures thereof.

According to some embodiments of the invention, said bacterial biopolymer layer comprises a bacterial biopolymer selected from bacterial cellulose, bacterial collagen, bacterial cellulose/chitin copolymer, bacterial silk, and mixtures thereof. These biopolymers are known per se in the art.

For example, a bacterial biopolymer according to the invention (e.g., the bacterial cellulose) can be produced by culturing bacterial biopolymer-producing microorganisms, which may be selected from bacteria, algae, yeast, fungi and mixtures thereof.

For example, a layer of bacterial collagen can be provided to the front side of the woven fabric and a layer of bacterial cellulose can be provided to the back side of the woven fabric.

According to embodiments of the invention, bacterial biopolymer-producing bacteria are selected from *Gluconacetobacter, Aerobacter, Acetobacter, Achromobacter, Agrobacterium, Azotobacter, Salmonella, Alcaligenes, Pseudomonas; Rhizobium, Sarcina, Streptoccoccus* and *Bacillus* genus, and mixtures thereof. According to embodiments of the invention, bacterial biopolymer-producing algae are selected from *Phaeophyta, Rhodophyta* and *Chrysophyta*, and mixture thereof.

For example, bacterial cellulose can be produced by culturing strains of *Acetobacter* bacteria, such as strains of *Acetobacter xylinum*, and/or by culturing strains of *Gluconacetobacter*, such as strains of *Gluconacetobacter hansenil.*

For example, bacterial collagen can be produced by culturing bacterial strains of *Bacillus, Pseudomonas, Streptoccoccus* or bacterial strains which have been genetically modified to obtain modified strains that produce collagen. Advantageously, bacterial collagen can be produced on the fabric to provide an artificial leather-like material, ("artificial leather" or "artificial skin", wherein the main structural component of "leather" and "skin" is type I collagen in the form of strong fibrils). For example, bacterial cellulose/chitin copolymer can be produced by culturing strains of *Acetobacter xylinum* which have been genetically modified to obtain modified strains that produce bacterial cellulose/chitin copolymer.

According to exemplary embodiments of the invention, the bacterial biopolymer producing microorganisms are a mixture of wild type and genetically modified microorganisms.

According to various embodiments, step c of the process is carried out by contacting at least part of at least one plurality of warp yarns and/or at least part of at least one plurality of weft yarns, or at least part of a woven fabric with a culture of bacterial biopolymer-producing microorganisms, and culturing said bacterial biopolymer-producing microorganisms, to provide at least part of said at least one plurality of warp yarns and/or at least part of said at least one plurality of weft yarns, or at least part of said woven fabric with a bacterial biopolymer layer.

In other words, a composite fabric according to step c of the present invention can be obtained by providing a woven fabric with a bacterial biopolymer layer, that is "grown" (i.e. produced) directly on the fabric.

For example, a composite fabric according to the invention, can be advantageously obtained by contacting the front side and/or the back side of a woven fabric, with a culture of bacterial biopolymer-producing microorganisms, and culturing said bacterial biopolymer-producing microorganisms. More in detail, once the woven fabric is contacted with a culture of bacterial biopolymer-producing microorganisms, bacterial biopolymer-producing microorganisms are cultured, to produce a layer of bacterial biopolymer directly on the fabric, thus providing a composite fabric according to step c of the process of the invention.

According to embodiments, at least part of at least one plurality of warp yarns and/or at least part of at least one plurality of weft yarns, as provided in step a of the process of the invention, are provided with a bacterial biopolymer layer before the weaving according to step b.

For example, a bacterial biopolymer layer (e.g. a bacterial cellulose layer), advantageously a thin bacterial biopolymer layer (e.g. a "film" of bacterial biopolymer) can be grown directly on cotton yarns.

Advantageously, a bacterial biopolymer layer, provided onto yarns (warp and/or weft yarns) before the weaving, act as sizing agent, thus protecting the yarns during the weaving process.

Additionally, the bacterial biopolymer provided onto the yarns protects the yarns from damages also after the weaving step.

Moreover, when the bacterial biopolymer layer (e.g. a bacterial biopolymer film) is grown (i.e. produced) directly on the warp and/or weft yarns, it is possible to skip the step of sizing the yarns before the weaving and to skip the step of de-sizing after the weaving, thus reducing the costs for the production.

According to exemplary embodiments, at least part of at least one plurality of warp yarns and/or at least part of at least one plurality of weft yarns, as provided in step a of the process of the invention, are provided with a bacterial biopolymer layer and dyed before the weaving step according to step b.

For example, a bacterial biopolymer according to the invention can be produced (i.e. "grown") on the yarns by contacting said yarns, with a culture of bacterial biopolymer-producing microorganisms, and culturing said bacterial biopolymer-producing microorganisms, before the weaving, thus providing "composite yarns".

According to embodiments of the invention, the "composite yarns" may be woven to provide a woven fabric provided with a biopolymer layer, which may be subsequently dyed. Alternatively, or additionally, the composite yarns may be dyed before the weaving step.

According to exemplary embodiments, a bacterial biopolymer layer may be provided to a woven fabric according to step c by growing, i.e. producing, the biopolymer layer on the fabric, or by coupling the woven fabric with a bacterial biopolymer layer which is separately produced.

For example, a bacterial biopolymer layer separately produced can be coupled with a woven fabric by lamination, e.g. the layer of bacterial biopolymer is attached to the woven fabric through a cross-linking process; in other exemplary embodiments, the bacterial biopolymer layer is sewn on the front side and/or the back side of the woven fabric.

According to embodiments, the bacterial biopolymer layer is produced and dissolved and, subsequently, the yarns and/or the woven fabric are contacted with the dissolved biopolymer, to provide a composite fabric according to step c of the invention.

According to some embodiments, step c of the process of the invention is carried out by contacting at least part of the woven fabric (or at least some of the yarns before weaving) with a culture of bacterial biopolymer-producing microorganisms, and culturing said bacterial biopolymer-producing microorganisms, to provide the woven fabric with a bacterial biopolymer layer, thus obtaining a composite fabric.

Advantageously, by producing (i.e. growing) the bacterial biopolymer layer on the woven fabric (or on at least some of the yarns before weaving), a non-uniform bacterial biopolymer layer, as above discussed, can be obtained.

According to exemplary embodiments, the woven fabric (or the yarns before the weaving) may be contacted with a culture of bacterial biopolymer-producing microorganisms, by dipping the fabric (or the yarns) into the culture of bacterial biopolymer-producing microorganisms.

In other words, according to exemplary embodiments, at least part of the woven fabric, or at least part of the yarns (e.g. the yarns before the weaving) is contacted with a culture of microorganisms producing a bacterial biopolymer, by dipping said at least part of said woven fabric or at least part of said yarns into said culture of bacterial biopolymer-producing microorganisms. Advantageously, when the woven fabric is dipped into the culture of bacterial biopolymer-producing microorganisms, the bacterial biopolymer layer grows on both the sides (i.e. the front side and the back side of the woven fabric), thus providing a composite fabric wherein the woven fabric is provided with two bacterial biopolymer layers, which comprise the same biopolymer.

According to other exemplary embodiments, the culture of bacterial biopolymer-producing microorganisms is sprayed on at least part of said woven fabric (or on at least some of the yarns before weaving), such as on at least part of the front side of said woven fabric.

According to embodiments, the culture of bacterial biopolymer-producing microorganisms is sprayed on at least part of said woven fabric through a mesh wire.

Advantageously, by spraying the culture of bacterial biopolymer-producing microorganisms on at least part of said woven fabric through a mesh wire, the bacterial biopolymer layer is grown, i.e. produced, on the woven fabric as a discontinuous and non-uniform bacterial biopolymer layer, as above discussed.

The mesh wire may be removed before dyeing once the bacterial biopolymer is grown on the woven fabric. Advantageously, when the mesh wire is removed after the bacterial biopolymer is grown on the woven fabric, a bacterial biopolymer layer having a defined pattern is obtained.

According to embodiments, a dissolved biopolymer is sprayed on at least part of said woven fabric, advantageously on at least part of the front side of said woven fabric, thus providing a composite fabric according to step c of the process of the invention. Advantageously, by spraying the dissolved biopolymer on at least part of said woven fabric through a mesh wire, a discontinuous (uniform or non-uniform) bacterial biopolymer layer, as above defined, can be obtained.

According to various embodiments, the warp yarns and/or weft yarns are hydrophilic yarns.

Advantageously, when the warp yarns and/or the weft yarns are hydrophilic yarns, the culture medium of the bacterial biopolymer-producing microorganisms is absorbed by the yarns (before the weaving) or by the woven fabric, thus providing nutrients to the microorganisms and ingredients for the synthesis of the bacterial biopolymer layer, directly on the woven fabric.

According to embodiments of the invention, hydrophilic yarns are natural yarns, i.e. yarns that are made of natural fibers.

The natural yarns may comprise natural fibers selected from cotton, wool, flax, kenaf, ramie, hemp, and mixtures thereof.

According to embodiments of the invention, hydrophilic yarns are synthetic yarns, i.e. yarns that are made of synthetic fibers.

The synthetic yarns may comprise synthetic fibers selected from polyester, rayon, nylon, lycra and mixtures thereof. According to some embodiments, synthetic yarns and/or synthetic fibers are treated (i.e. finished) in order to provide synthetic yarns and/or synthetic fiber having hydrophilic properties.

For example, a synthetic yarns and/or synthetic fibers, that is not hydrophilic per se, can be treated with a hydrophilizing agent in order to gain hydrophilic features. According to embodiments, hydrophilic yarns are mixed yarns, i.e. yarns that comprise both natural and synthetic fibers. In this case, for example, a hydrophilic mixed yarn can be obtained by mixing hydrophilic natural fibers and hydrophobic synthetic fibers.

In embodiments of the invention, the warp yarns and/or the weft yarns are selected from natural yarns, synthetic yarns and mixed yarns. According to some embodiments, warp yarns and/or weft yarns are natural yarns. The natural yarns may comprise natural fibers selected from cotton, wool, flax, kenaf, ramie, hemp, and mixtures thereof.

In other embodiments of the invention, the warp yarns and/or the weft yarns are synthetic yarns, such as thermoplastic yarns which may advantageously be thermoplastic elastomeric yarns. The synthetic yarns may be synthetic fibers selected from polyester, rayon, nylon, lycra and mixtures thereof.

In various embodiments of the invention, the warp yarns and/or the weft yarns of the woven fabric are mixed yarns, i.e. yarns comprising both natural fibers and synthetic fibers. In various embodiments of the invention, natural fibers and yarns are hard fibers and yarns. In exemplary embodiments of the invention, synthetic fibers and yarns are elastomeric fibers and yarns.

Suitable elastomeric yarns are yarns containing elastomeric fibers. An "elastomeric fiber" is a fiber made of a continuous filament or a plurality of filaments which have an elongation at break of at least 100%, independent of any crimp. Break elongation may be measured e.g. according to standard testing procedure ASTM D2256/D2256M-10 (2015) by ASTM International, West Conshohocken, Pa., USA. An "elastomeric fiber" is a fiber that after being stretched to twice its length and held for one minute at said length, will retract to less than 1.5 times its original length within one minute of being released.

According to one embodiment, a woven fabric suitable for use in the invention comprises warp yarns and weft yarns woven together, and has a front side and a back side, wherein said warp yarns and at least one plurality of weft yarns form a base layer of said woven fabric, and wherein a plurality of warp yarns and/or at least one plurality of weft yarns forms an additional layer of loop portions, on at least one of the sides of said woven fabric.

According to exemplary embodiments, fabric structures suitable to be used as "woven fabric" in a process according to the present invention are disclosed in patent application publication US2015/0038042 (see in particular paragraphs [0013], [0019]-[0027], [0030], [0031], [0033], [0049]-[0051], [0054], [0055], [0060], [0066], [0068][0071], [0075], [0076], [0078]-[0083], [0086], [0089]-[0117]) and in patent application US2013/0048140 (see in particular paragraphs [0007], [0010], [0013]-[0018], [0041]-[0046], [0048]-[0050], [0054]-[0059] and Examples 1, 3-8 and 10) whose descriptions are incorporated herein by reference.

In various embodiments, at least part of said additional layer of loop portions is included, e.g. embedded, into the bacterial biopolymer layer. The composite fabric of the present invention, may be a composite fabric as disclosed in co-pending application having title "Composite fabric comprising a bacterial biopolymer layer" in the name of the present applicant.

According to various embodiments, the woven fabric is a denim fabric.

According to embodiments of the invention, step d of the process of the invention is carried out by print-dyeing, such as by indigo print-dyeing or by dipping the composite fabric into a dye bath (for example, an indigo bath).

The best results are obtained with print-dyeing, dye-coating where the dye is applied only on the side of the fabric where the bacterial biopolymer (e.g. bacterial cellulose) is grown. That way the bacterial biopolymer (e.g. bacterial cellulose) behave as a barrier, hence unique visual effects can be obtained.

However, very good results were also obtained via conventional indigo dyeing methods, where the fabric is dipped into indigo bath (both sides of the fabric are dyed) and only during the washing treatments, as the bacterial biopolymer (e.g. bacterial cellulose) is removed, the color-shade variation appears. Here again, the thickness of the bacterial cellulose has an important role. The thicker the bacterial biopolymer (e.g. bacterial cellulose) is, the less of the dye can penetrate to the center of individual fibers, hence a shallow ring effect is observed and vice versa when the thickness is less the ring effect is deeper. This overall, creates visual color variations especially during washing treatments.

Advantageously, when the composite fabric, as obtained in step c, is dyed by print-dyeing, the print-dyeing is carried out on the side of the composite fabric where the bacterial biopolymer layer is placed.

In this case, advantageously, the bacterial biopolymer layer acts as a barrier during the print-dyeing process, thus preventing damages to the woven fabric underlying the bacterial biopolymer layer, and preventing the penetration of a great amount of dye into the woven fabric. For example, as above discussed, depending on the thickness and/or the pattern (i.e. continuity or discontinuity) of the bacterial biopolymer layer, the amount of dye which reaches and penetrates into the woven fabric varies.

According to embodiments, step d is carried out by dyeing said composite fabric with a dye selected from the group of indigo dye, sulfur dye, pigment dye, reactive dye. One method of application of the selected dye is print-dyeing; when print dyeing is used, any dye such as vat, direct, reactive can be used.

According to embodiments, step e of the process of the invention is carried out by finishing treatments, e.g. rinse wash, enzyme washing, stone washing, laser treatments etc., as well as laundry washing, in order to remove at least part of said at least one bacterial biopolymer layer from said composite fabric, thus providing a treated fabric according to the invention.

In other words, a bacterial biopolymer layer can be removed, at least in part, from the composite fabric by washing, e.g. laundry washing, the dyed composite fabric with water, thus substantially avoiding the use of chemical agents. According to embodiments, the step e of the process of the invention is carried out by abrading at least part of said at least one bacterial biopolymer layer from said composite fabric.

In other words, the removal of the bacterial biopolymer layer from the composite fabric, to obtain a treated fabric is carried out by abrading (i.e. "rubbing", "scraping") the bacterial biopolymer layer, damaging the biopolymer layer, removing substantially all the biopolymer layer, without damaging the fabric.

According to various embodiments, step e may be carried out by stone-washing said dyed composite fabric obtained in step d.

Advantageously, the stone washing of the composite fabric as obtained in step d of the process of the invention, i.e. the washing of the composite fabric in the presence of pumice stones, allows the effective and fast removal of the bacterial biopolymer layer, without damaging the woven fabric underlying the biopolymer layer, thus providing a treated fabric having a multi-shaded effect without affecting (i.e. reducing) the mechanical integrity and the properties of the fabric, such as the tensile strength.

According to an embodiment, step e is carried out by bio-stoning said dyed composite fabric obtained in step d.

Advantageously, the bio-stoning of the composite fabric as obtained in step d. of the process of the invention, i.e. the washing of the composite fabric in the presence of enzymes able to provide the removal of the bacterial biopolymer layer from the composite fabric, provides a treated fabric having a multi-shaded effect without affecting (i.e. reducing) the mechanical integrity and the properties of the fabric, such as the tensile strength, and substantially avoiding the use chemical agents and pollutants.

According to embodiments of the invention, step e. is carried out by laundry washing and/or stone washing and/or bio-stoning a garment comprising a composite fabric as obtainable in step d. of the process of the invention.

According to embodiments of the invention, step e. is carried out by laser treatment.

Another object of the invention is a treated fabric as obtainable by a process according to the invention.

Advantageously, a treated fabric obtained through the process of the invention presents a "multi-shaded" effect, namely a "multi-shaded" appearance, previously not available through known finishing processes. Specifically, as above discussed, the obtained "multi-shaded" effect comprises a plurality of shades of color, which are distributed throughout the fabric (and throughout a garment comprising it) according to a non-reproducible pattern, such as the same distribution of shades cannot be reproduced from a fabric to another.

According to an aspect of the invention, the "multi-shaded" effect of the treated fabric, depends on the thickness and/or the pattern (i.e. the continuity or discontinuity) of the bacterial biopolymer layer, which is provided onto the non-treated woven fabric, according to point c. of the process of the invention. For example, a "non-treated" woven fabric is provided with a bacterial biopolymer layer, thus providing a composite fabric. The composite fabric is subsequently dyed. At least part of the bacterial biopolymer layer is then removed from the dyed composite fabric, thus providing a treated fabric having a "multi-shaded" effect.

As above mentioned, the "multi-shaded" effect of the treated fabric, depends of the thickness and/or the pattern (i.e. the continuity or discontinuity) of the bacterial biopolymer layer.

For example, a bacterial biopolymer layer can have a thickness T which schematically assumes three different values, namely T1, T2 and T3, where T3>T2>T1.

In this case, the dye uptake of the biopolymer layer where the thickness is T3 is more than the uptake where the thickness is T2, which is, in turn, more than the uptake where the thickness is T1. Therefore, if a certain amount of dye reaches the woven fabric underlying the bacterial biopolymer layer where the thickness of the biopolymer layer is T1, a lower amount of dye reaches the woven fabric where the thickness of the biopolymer layer is T2, and an even lower amount of dye reaches the woven fabric where the thickness is T3. In this case, a treated fabric having three different shades of color can be obtained.

It has to be noted that the above-mentioned example is merely a schematic description, in fact, the treated fabric of the invention has a "multi-shaded" appearance, i.e. the treated fabric presents numerous different color shades, due to the different penetration of the dye throughout the bacterial biopolymer layer.

According to embodiments of the invention, a treated fabric according to the invention comprises dyed yarns and portions of a dyed biopolymer layer; in other words, in embodiments of the invention a treated fabric as obtainable by a process according to the invention comprises residual bacterial biopolymer regions, i.e. regions wherein the bacterial biopolymer layer has been not completely removed.

A further object of the present invention is a garment comprising a treated fabric as obtainable by the process of the invention.

According to some embodiments, in a garment according to the invention, the front side of the treated fabric is the external visible side when the garment is worn, and the back side of the treated fabric is the internal not visible side when the garment is worn.

Another object of the present invention is a garment comprising a composite fabric as obtainable with the process of the invention. The fabric may be tailored into a garment after step b or c of the process of the invention.

According to embodiments of the invention, when a garment comprises a composite fabric as obtainable in step c or step d of the process of the invention, a "multi-shaded" effect can be advantageously obtained by removing at least part of the bacterial biopolymer layer from the garment, i.e. by removing at least part of the bacterial biopolymer layer from the composite fabric, after the composite fabric has been used for the production of a garment.

BRIEF DESCRIPTION OF THE DRAWINGS

Further aspects and advantages of the present invention will be discussed more in detail with reference to the enclosed drawings, given by way of non-limiting example, wherein.

DETAILED DESCRIPTION

According to an aspect of the invention, the structure of the treated fabric is substantially the same of the non-treated woven fabric (i.e. the woven fabric before steps c, d and e of the process identified above). In other words, the process of the invention does not substantially modify the structure of the woven fabric which is subjected to the process of the invention.

Therefore, in this embodiment the "woven fabric" 1 (i.e. the fabric before steps c, d and e of the process of the invention) and the "treated fabric" 100 (i.e., the fabric after step e. of the process of the invention) shall be interpreted to be the same fabric before and after the process of the invention. In other words, a treated fabric is the woven fabric after having been treated according to the invention.

Figure 1:
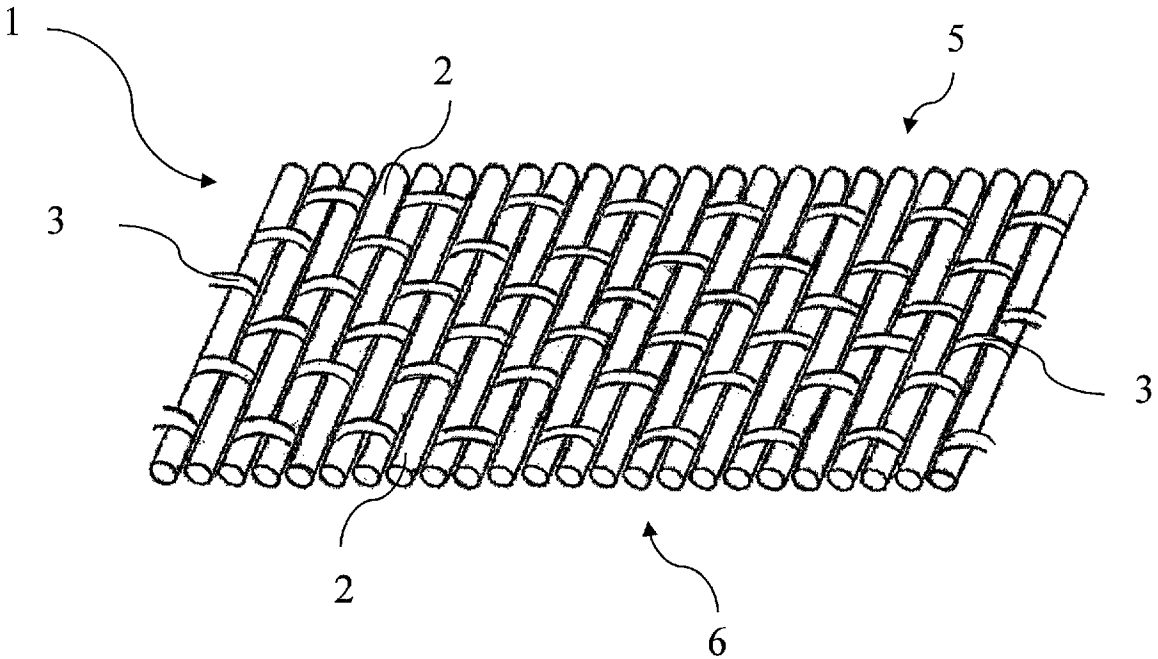
FIG. 1 is a perspective view of a portion of an exemplary woven fabric according to the invention, before undergoing step c of the process of the invention, i.e. a not-treated woven fabric.

FIG. 1 is a perspective view of a portion of an exemplary woven fabric 1 according to the invention, before undergoing step c of the process of the invention, i.e. a not-treated woven fabric.

FIG. 1 shows a woven fabric 1, having warp yarns 2 and weft yarns 3, and having a front side 5 and a back side 6. Weft yarns 3 and warp yarns 2 are woven in a pattern wherein weft yarns 3 pass over two warp yarns 2, on the front side 5 of the fabric, and under one warp yarn 2 on the back side 6.

It has to be noted that the weaving pattern illustrated in the present figures have to be intended as merely representative, and not limiting of the scope of the invention; in fact any kind of weaving pattern have to be considered as included in the scope of the claims. As above mentioned, the weaving pattern may contribute to the final appearance.

The woven fabric 1 represented in FIG. 1 is not dyed.

Figure 2:
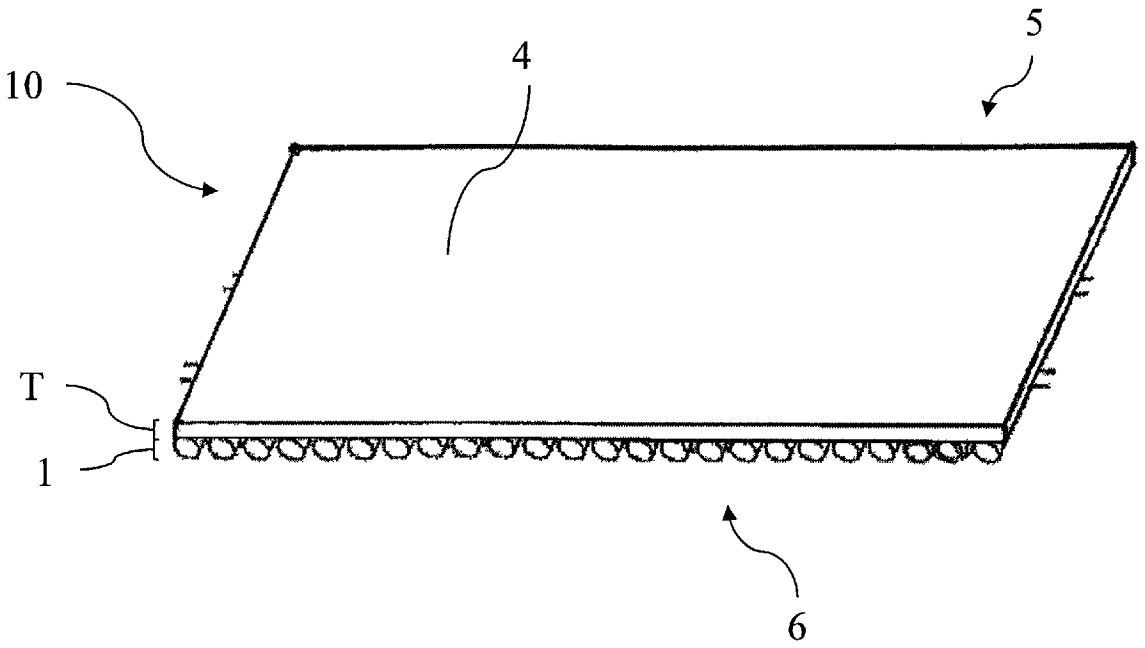
FIG. 2 is a perspective view of a portion of a composite woven fabric according to the invention, as obtainable after step c of the process of the invention, i.e. a woven fabric provided with a bacterial polymer layer.

FIG. 2 is a perspective view of a portion of an exemplary composite fabric 10, as obtainable after step c of the process of the invention. A woven fabric 1 is provided with a bacterial biopolymer layer 4, on its front side 5, thus providing a composite fabric 10.

The back side 6 of the woven fabric 1 is also indicated in FIG. 2. In this case, the back side 6 of the woven fabric 1 corresponds to the back side of the composite fabric 10.

In the embodiment of FIG. 2, the bacterial biopolymer layer 4 is schematically represented as a continuous and uniform layer, i.e a layer that covers continuously (i.e. without interruptions) the front side 5 of the woven fabric 1 and that maintains substantially the same thickness T over its entire extension. According to some embodiments, the bacterial biopolymer layer 4 is produced directly on the woven fabric 1, namely by culturing bacterial biopolymer-producing microorganisms directly on the woven fabric 1.

For example, the woven fabric 1 can be contacted with a culture of bacterial biopolymer-producing microorganisms, which are cultured directly on the woven fabric 1. By culturing the microorganisms directly on the woven fabric 1, the growing (i.e. the production) of a bacterial biopolymer layer 4 on the woven fabric 1 can be obtained.

In embodiments of the invention, the bacterial biopolymer layer 4 is a non-uniform layer, i.e. it has a thickness T which is variable throughout the extension of the bacterial biopolymer layer 4.

In embodiments of the invention, the bacterial biopolymer layer 4 is a discontinuous layer, i.e. is an interrupted layer, thus providing areas of the woven fabric 1 which are not provided (i.e. not covered) with the bacterial biopolymer layer 4.

Figure 3:
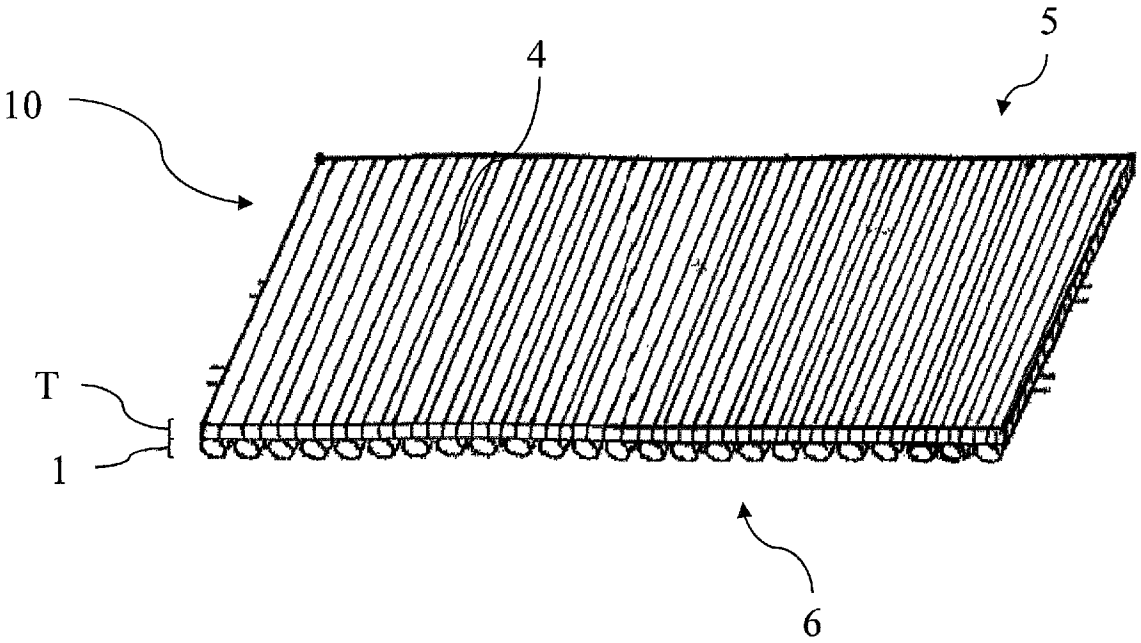
FIG. 3 is a perspective view of a portion of an exemplary composite fabric according to the invention, as obtainable after step d of the process of the invention, i.e. a dyed composite fabric.

FIG. 3 is a perspective view of a portion of an exemplary composite fabric 10, as obtainable after step d of the process of the invention, i.e. a dyed composite fabric. FIG. 3 shows, in particular, the bacterial biopolymer layer 4 after dyeing. Similar to FIG. 2, the bacterial biopolymer layer 4 is schematically represented as a continuous and uniform layer, i.e. a layer that covers continuously (i.e. without interruptions) the front side 5 of the woven fabric 1 and that maintains substantially the same thickness T over its entire extension. However, as above mentioned, in embodiments of the invention the bacterial biopolymer layer 4 is discontinuous and/or non-uniform. The back side 6 of the woven fabric 1 is also indicated in FIG. 3. In this case, the back side 6 of the woven fabric 1 corresponds to the back side of the composite fabric 10.

Figure 4:
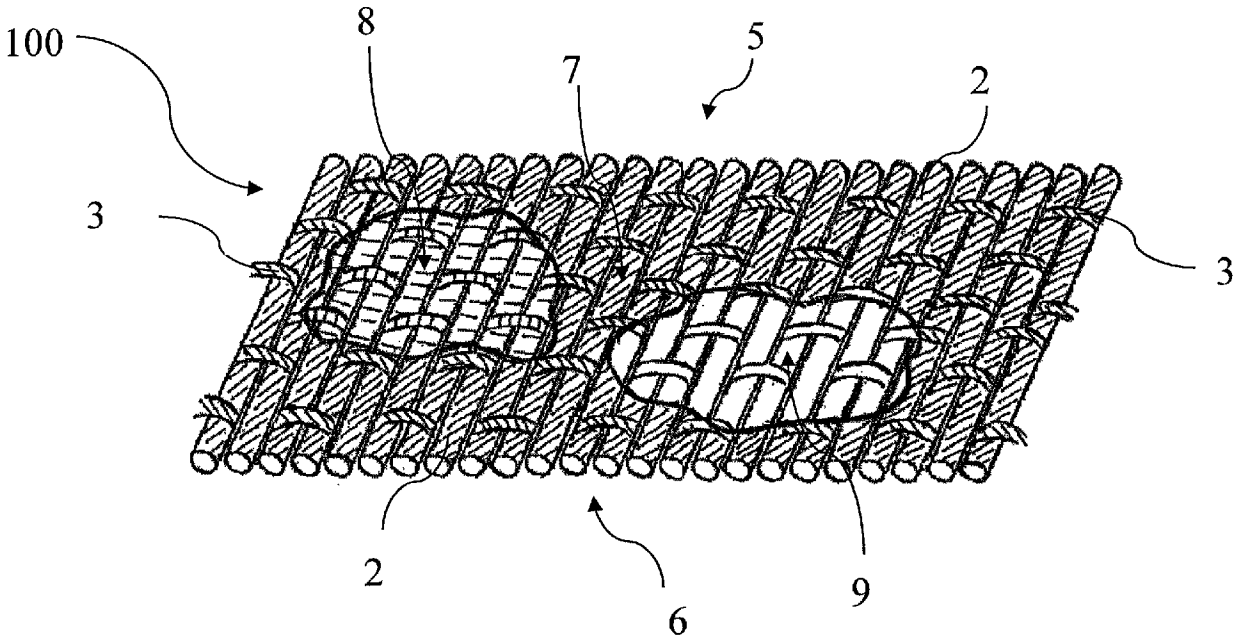
FIGS. 4, 5, 6 and 7 are perspective views of exemplary embodiments of the treated fabric as obtainable by the process of the invention.

FIG. 4 shows a perspective view of an exemplary embodiment of a treated fabric 100 as obtainable by the process of the invention, i.e. after that at least part of the bacterial biopolymer layer 4 is removed from the composite fabric 10.

FIG. 4 shows a treated fabric 100, having warp yarns 2 and weft yarns 3, and having a front side 5 and a back side 6. Weft yarns 3 and warp yarns 2 are woven in a pattern wherein weft yarns 3 pass over two warp yarns 2, on the front side 5 of the fabric, and under one warp yarn 2 on the back side.

FIG. 4 shows, schematically, an embodiment wherein the bacterial biopolymer layer 4 has been completely removed from the composite fabric 10, e.g. from the front side 5 of the woven fabric 1.

The treated fabric 100, in the embodiment represented in FIG. 4, presents, on its front side 5, first regions 7 that are intensely colored, second regions 8 that are slightly colored (i.e., dyed with a lighter shade of color than the first regions 7), and third regions 9 that are substantially not colored, i.e. not dyed. FIG. 4 shows an embodiment if the treated fabric 100 wherein first regions 7 cover the most of the front side 5 of the treated fabric 100. The treated fabric 100 of FIG. 4 presents second regions 8 which are colored with a lighter shade of color than the first regions 7, and also presents third regions 9 which are substantially not dyed.

Accordingly, a treated fabric 100 as shown in FIG. 4 is substantially intensely dyed, and presents regions in a lighter shade and not-dyed regions, thus providing a substantially "light on dark" shade effect, namely a "light on dark" worn out look.

It has to be noted that FIG. 4 is merely a schematic representation of a treated fabric 100 according to the invention; in fact, the treated fabric 100 of the invention have a "multi-shaded" appearance, i.e. the treated fabric 100 presents numerous different color shades, due to the different penetration of the dye throughout the bacterial biopolymer layer 4, namely through the thickness T of the bacterial biopolymer layer 4.

This is particularly true in the embodiments of the invention, where the bacterial biopolymer layer 4 has a thickness T that is non-uniform, i.e. that is not the same throughout the extension of the bacterial biopolymer layer 4; in other words, where thickness T assumes different values in different regions of the bacterial biopolymer layer 4.

In fact, if the composite fabric 10 presents a bacterial biopolymer layer 4 having variable thickness T, the dye uptake of the composite fabric 10 is variable in relationship with the variable thickness T of the bacterial biopolymer layer 4.

In particular, it has been observed that, the higher is the thickness T, the higher is the dye uptake of the bacterial biopolymer layer 4. In other words, when a composite fabric 10 presents a bacterial biopolymer layer 4 having variable thickness T, different amounts of dye reach the surface (i.e., for example, the front side 5) of the woven fabric 1, in relationship with the variation of the thickness T along the extension of the bacterial biopolymer layer 4.

For example, if the thickness T of the bacterial biopolymer layer is high, only a little amount (or none) dye reaches the surface (i.e., for example, the front side 5) of the woven fabric 1, thus providing a treated fabric 100 with second regions 8 that are slightly colored and/or third regions 9 that are substantially not colored, i.e. not dyed.

On the contrary, for example, if the thickness T of the bacterial biopolymer layer is low, a greater amount of dye reaches the surface (i.e., for example, the front side 5) of the woven fabric 1, thus providing a treated fabric 100 with first regions 7, that are intensely colored.

According to various advantageous embodiments of the invention, growing the bacterial biopolymer layer 4 directly on the woven fabric 1, a bacterial biopolymer layer 4 having a variable thickness T can be obtained.

For example, a treated fabric 100, according to FIG. 4, can be obtained when the bacterial biopolymer layer 4 (removed according to step e of the process of the invention) has a thickness T having value T1 in correspondence of the first regions 7, a thickness T2>T1 in correspondence of second regions 8, and a thickness T3>T2>T1 in correspondence of third regions 9. In this case, according to FIG. 4, where the thickness T of the bacterial biopolymer layer 4 is T3, substantially all the dye is absorbed by the bacterial biopolymer layer 4; in other words, the dye does not substantially reach the surface (e.g. the front side 5) of the woven fabric 1, thus providing a treated fabric 100 having third regions 9 that are substantially not colored. Additionally, where the thickness T of the bacterial biopolymer layer 4 is T2, only part of the dye reaches the surface (e.g. the front side 5) of the woven fabric 1, thus providing a treated fabric 100 having second regions 8 that are slightly colored.

Moreover, where the thickness T of the bacterial biopolymer layer 4 is T1, substantially all the dye reaches the surface (i.e. the front side 5) of the woven fabric 1, thus providing a treated fabric 100 having first regions 7, that are intensely colored.

Accordingly, a treated fabric 100 as shown in FIG. 4 is substantially dyed, and presents not-dyed regions (namely third regions 9), and regions colored in a lighter shade (namely second regions 8), thus providing a "light on dark" shade effect, namely a "light on dark" worn out look.

Figure 5:
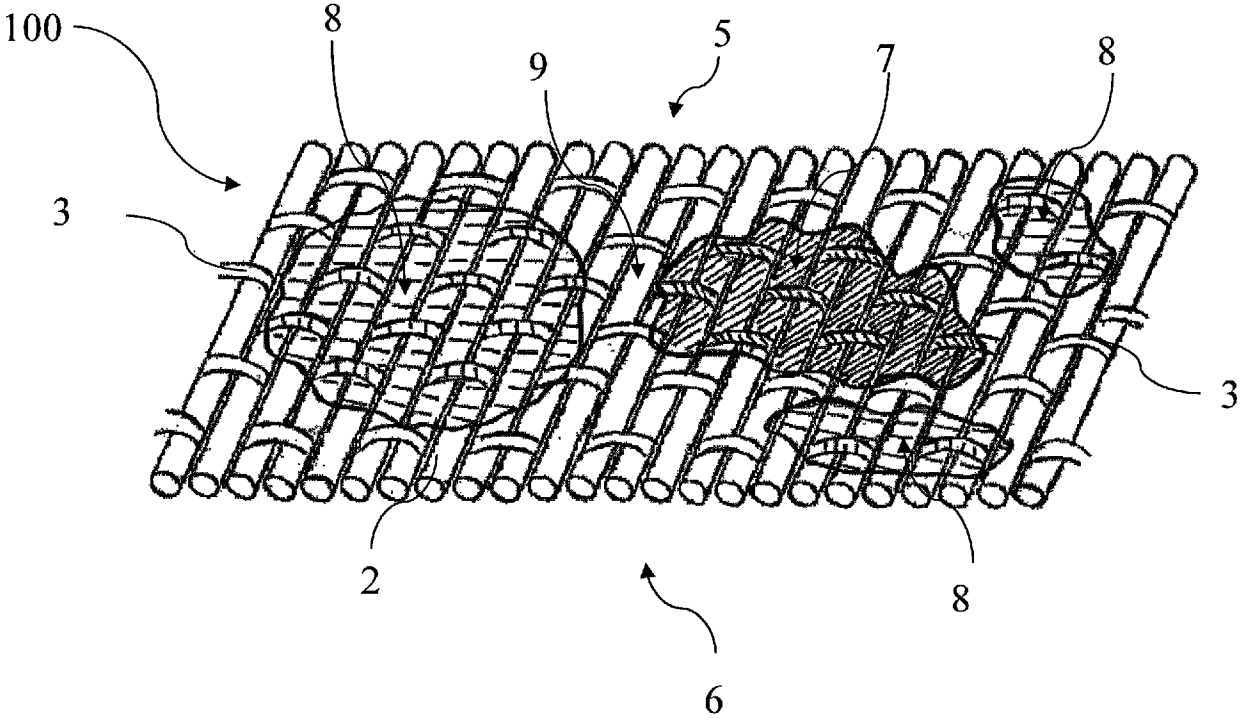

FIG. 5 shows a perspective view of an exemplary embodiment of a treated fabric 100 as obtainable by the process of the invention, i.e. after that at least part of the bacterial biopolymer layer 4 is removed from the composite fabric 10.

FIG. 5 shows a treated fabric 100, having warp yarns 2 and weft yarns 3, and having a front side 5 and a back side 6. Weft yarns 3 and warp yarns 2 are woven in a pattern wherein weft yarns 3 pass over two warp yarns 2, on the front side 5 of the fabric, and under one warp yarn 2 on the back side 6.

FIG. 5 shows an embodiment, wherein the bacterial biopolymer layer 4 has been completely removed the composite fabric 10, e.g. from the front side 5 of the woven fabric 1, in step e of the process of the invention.

FIG. 5 represents a treated fabric 100 having, in its front side 5, first regions 7 that are intensely colored, second regions 8 that are slightly colored (i.e., dyed with a lighter shade of color than the first regions 7), and third regions 9 that are substantially not colored, i.e. not dyed. FIG. 5 shows an embodiment of the treated fabric 100 wherein third regions 9 cover the most of the front side 5 of the treated fabric 100. Treated fabric 100 presents first regions 7, which are intensely dyed, and second regions 8 which are colored with a lighter shade of dye than the first regions 7.

Therefore, a treated fabric 100 as shown in FIG. 5 is substantially not dyed, and presents intensely dyed regions (namely first regions 7), and slightly colored regions (namely second regions 8), thus providing a "dark on light" shade effect, namely a "dark on light" worn out look.

For example, a treated fabric 100 according to FIG. 5 can be obtained, when the bacterial biopolymer layer 4 (removed with step e of the process of the invention) has a thickness T1 in correspondence of the first regions 7, a thickness T2>T1 in correspondence of second regions 8, and a thickness T3>T2>T1 in correspondence of third regions 9.

For example, a bacterial biopolymer layer 4 having variable thickness T can be obtained by growing (i.e. producing) said biopolymer directly on the surface of the fabric, namely, on the front side 5 of the woven fabric 1.

In this case, according to FIG. 5, where the thickness T the bacterial biopolymer layer 4 is T3, substantially all the dye is absorbed by the bacterial biopolymer layer 4; in other words, the dye does not substantially reach the surface (e.g. the front side 5) of the woven fabric 1, thus providing a treated fabric 100 having third regions 9 that are substantially not colored. Additionally, where the thickness T of the bacterial biopolymer layer 4 is T2, only part of the dye reaches the surface (e.g. the front side 5) of the woven fabric 1, thus providing a treated fabric 100 having second regions 8 that are slightly colored. Moreover, where the thickness T of the bacterial biopolymer layer 4 is T1, substantially all the dye reaches the surface (i.e. the front side 5) of the woven fabric 1, thus providing a treated fabric 100 having first regions 7, that are intensely colored.

As already mentioned, FIG. 5, as FIG. 4, has to be intended as a schematic representation of a treated fabric 100 according to the invention, because, the treated fabric 100 according to the invention presents numerous different color shades (i.e. a multi-shaded effect), due to the different penetration of the dye, through the thickness T of the bacterial biopolymer layer 4.

Figure 6:
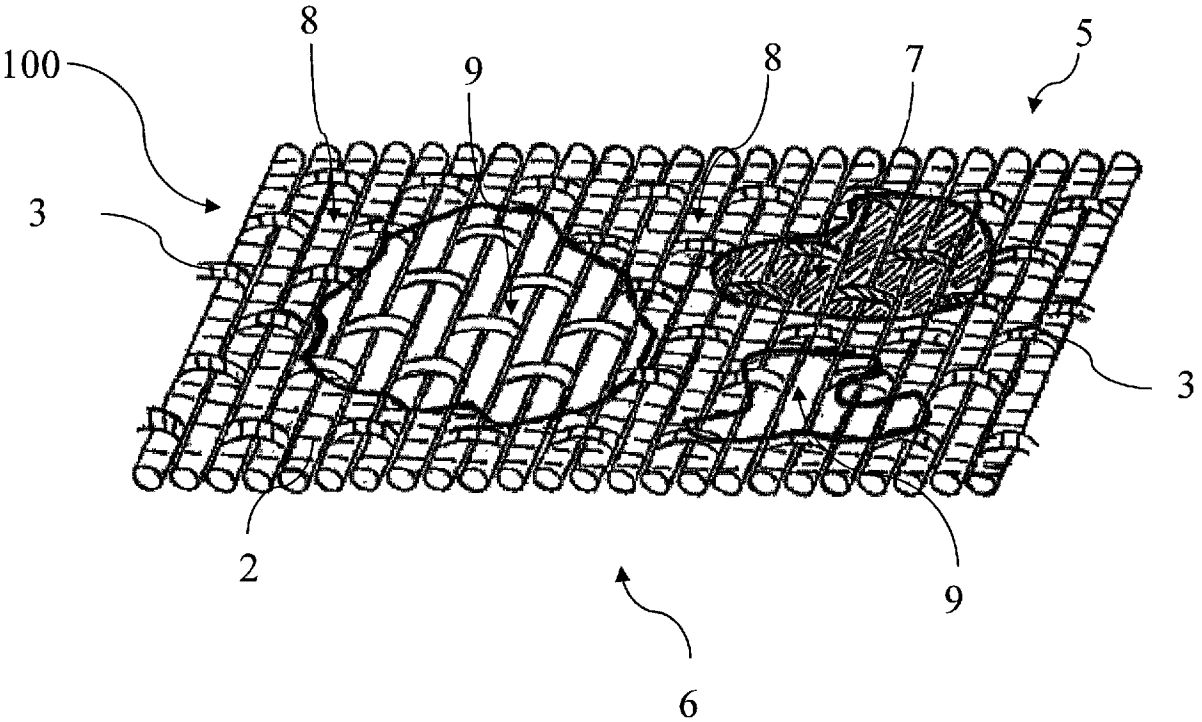

FIG. 6, shows a perspective view of an exemplary embodiment of a treated fabric 100, having warp yarns 2 and weft yarns 3, and having a front side 5 and a back side 6, as obtainable by the process of the invention, i.e. after that at least part of the bacterial biopolymer layer 4 is removed from the composite fabric 10.

FIG. 6 shows an embodiment, wherein the bacterial biopolymer layer 4 has been completely removed from the composite fabric 10, e.g. from the front side 5 of the woven fabric 1, in step e of the process of the invention.

FIG. 6 shows an embodiment of the treated fabric 100 wherein second regions 8 cover the most of the front side 5 of the treated fabric 100. Treated fabric 100 presents first regions 7, which are intensely dyed, and third regions 9 which are substantially not dyed.

Therefore, a treated fabric 100 as shown in FIG. 6 is substantially "slightly dyed", and presents intensely dyed regions (namely first regions 7), and substantially not-dyed regions (namely third regions 9), thus providing a "mixed" shade effect, i.e. a combination of a "dark on light" shade effect and a "light on dark" shade effect, e.g. a "mixed" worn out look.

For example, a treated fabric 100 according to FIG. 6 can be obtained, when the bacterial biopolymer layer 4 (removed with step e of the process of the invention) has a thickness T1 in correspondence of the first regions 7, a thickness T2>T1 in correspondence of second regions 8, and a thickness T3>T2>T1 in correspondence of third regions 9. For example, a bacterial biopolymer layer 4 having variable thickness T can be obtained by growing (i.e. producing) said biopolymer directly on the surface of the fabric, namely, on the front side 5 of the woven fabric 1. In this case, according to FIG. 6, where the thickness is T3, the dye does not substantially reach the surface (i.e. the front side 5) of the woven fabric 1, thus providing a treated fabric 100 having third regions 9 that are substantially not colored. Where the thickness of the bacterial biopolymer layer 4 is T1, substantially all the dye reaches the woven fabric 1, thus providing a treated fabric 100 having first regions 7, that are intensely colored.

Additionally, where the thickness is T2, only part of the dye reaches the surface (i.e. the front side 5) of the woven fabric 1, thus providing a treated fabric 100 having second regions 8 that are slightly colored.

Figure 7:
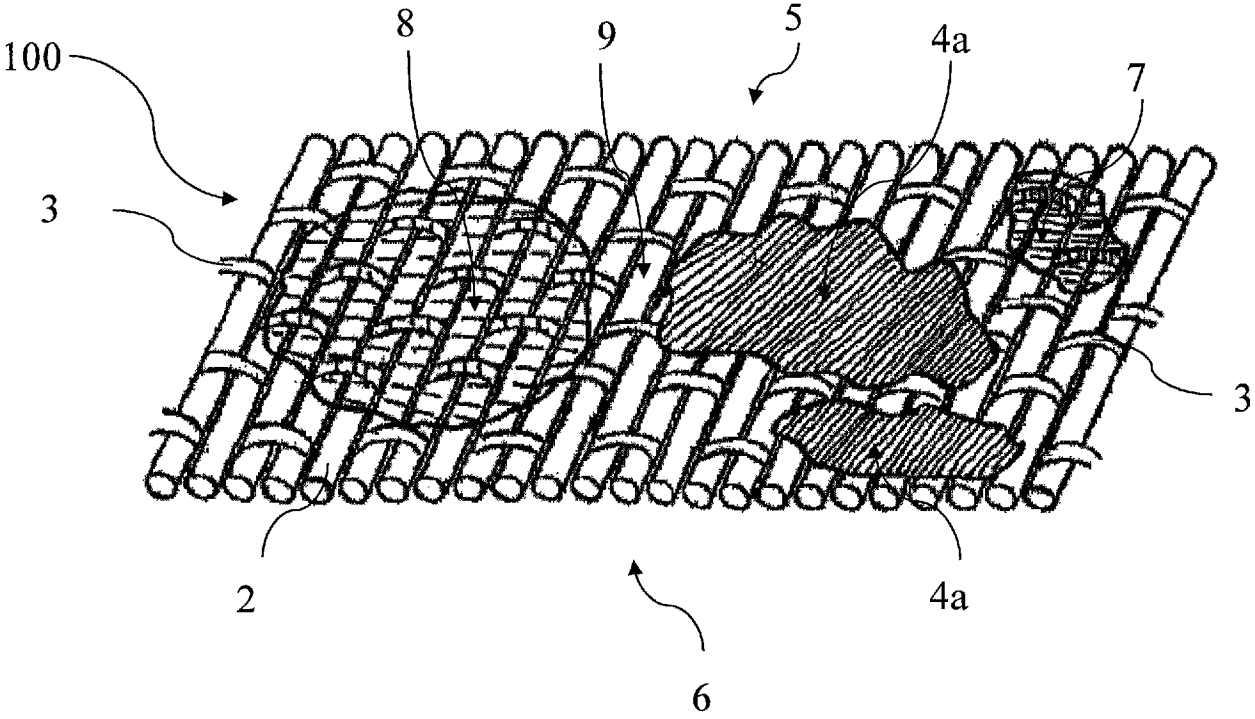

FIG. 7, illustrates an exemplary embodiment of the treated fabric 100, having warp yarns 2 and weft yarns 3, and having a front side 5 and a back side 6, as obtainable by the process of the invention, i.e. after that at least part of the bacterial biopolymer layer 4 is removed from the composite fabric 10.

FIG. 7 shows an embodiment, wherein the bacterial biopolymer layer 4 has been partially removed (i.e. not completely removed) from the composite fabric 10, e.g. from the front side 5 of the woven fabric 1, in step e of the process of the invention.

FIG. 7 shows an embodiment of the treated fabric 100 wherein residual bacterial biopolymer regions 4*a* are present on the front side 5 of the treated fabric 100. Said residual bacterial biopolymer regions 4*a* are dyed.

The embodiment of FIG. 7 presents third regions 9, which cover the most of the front side 5 of the treated fabric 100; in other words, the most of the front surface of the treated fabric 100 is not dyed. Treated fabric 100 presents first regions 7, which are intensely dyed, and second regions 8 that are slightly colored (i.e., dyed with a lighter shade of color than the first regions 7).

The presence of the dyed residual bacterial biopolymer regions 4*a* on the treated fabric 100, provide a further "visual effect" which combines the peculiar color shade of the dyed bacterial biopolymer layer 4 with all the other shades of color on the treated fabric 100. Additionally, the presence of the residual bacterial biopolymer regions 4*a* provides the treated fabric 100 with a hand feel that is different from the hand feel of a fabric wherein the bacterial biopolymer layer 4 has been completely removed. With the varying of the amount of residual bacterial biopolymer layer 4 on the treated fabric 100 different hand touch effects can be obtained.

Figure 8:
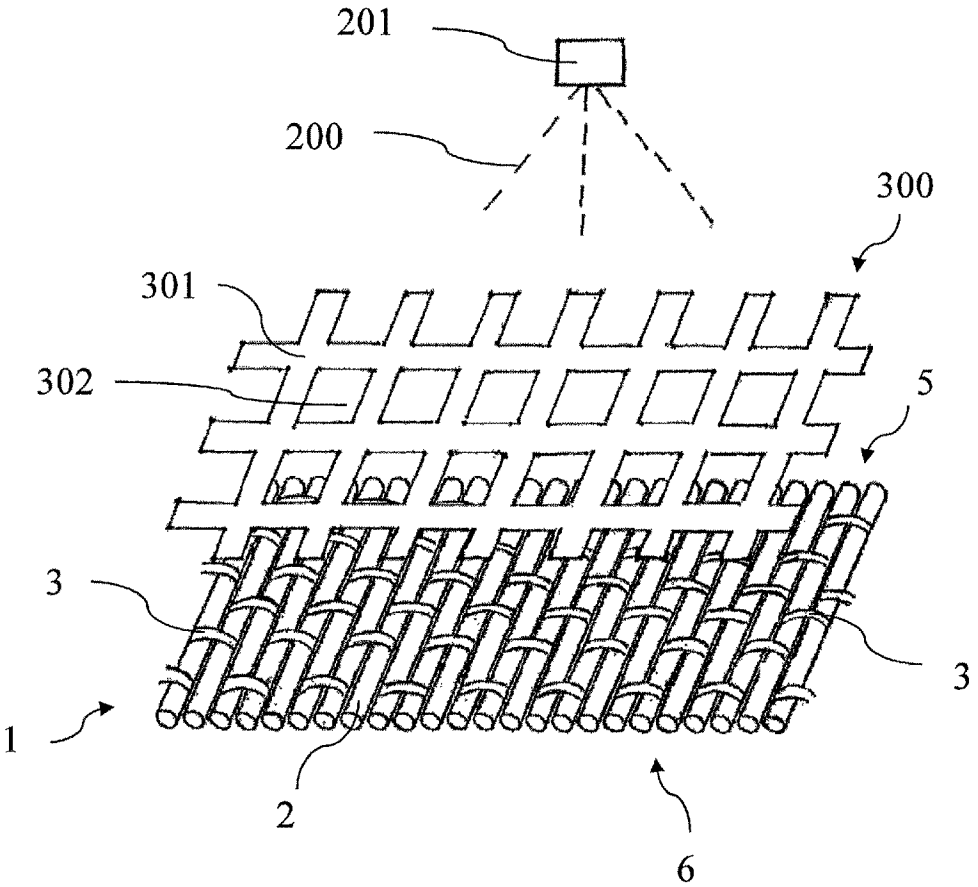
FIG. 8 shows an embodiment of the invention, wherein a culture of bacterial biopolymer-producing microorganisms is sprayed on an exemplary woven fabric through a mesh wire.

FIG. 8 shows an embodiment of the process of the invention, wherein the culture of bacterial biopolymer-producing microorganisms 200 is sprayed on an exemplary woven fabric 1 through a mesh wire 300. Woven fabric 1, has warp yarns 2 and weft yarns 3, and has a front side 5 and a back side 6. The woven fabric 1 represented in FIG. 8 is not dyed. In the embodiment of the process of the invention illustrated in FIG. 8, the culture of bacterial biopolymer-producing microorganisms 200 is sprayed on an exemplary woven fabric 1 through a mesh wire 300, by spraying means 201. The mesh wire 300 is placed between the woven fabric 1 and the spraying means 201, and has a mesh wire structure 301 defining mesh wire windows 302.

Spraying the culture of bacterial biopolymer-producing microorganisms 200 through the mesh wire 300, results in a non-homogeneous distribution of the biopolymer-producing microorganisms on the woven fabric 1. For example, a patterned distribution of the biopolymer-producing microorganisms can be obtained, thus providing the woven fabric 1, with regions that are contacted by the culture of biopolymer-producing microorganisms 200 and other regions that are not contacted by the sprayed culture of bacterial biopolymer-producing microorganisms 200. The mesh wire 300 may be made of any material; application of the bacterial culture may be made by screen-printing.

In other words, the mesh wire 300, that is placed on the front side 5 of the woven fabric 1, "hides" some regions of the woven fabric 1, i.e., the regions of the woven fabric 1 which lie under the mesh wire structure 301. The regions of the woven fabric 1 that are "hidden" by the mesh wire structure 301 are substantially not contacted by the culture of bacterial biopolymer-producing microorganisms 200 which is sprayed from the spraying means 201.

On the contrary, the sprayed culture of bacterial biopolymer-producing microorganisms 200 can reach the woven fabric 1 by passing through the mesh wire windows 302 of the mesh wire 300, which do not hide the woven fabric 1, and leave the portion of the woven fabric 1 in correspondence of the mesh wire windows 302 free to be contacted by the culture of bacterial biopolymer-producing microorganisms 200, sprayed by the spraying means 201.

As above mentioned, by culturing the bacterial biopolymer-producing microorganisms directly on the woven fabric 1, it is possible to grow (i.e. to produce) a bacterial biopolymer layer 4 directly on the woven fabric 1.

In exemplary embodiments, when the distribution of the biopolymer-producing microorganisms on the woven fabric 1 is a non-homogeneous distribution, a discontinuous (i.e. interrupted), bacterial biopolymer layer 4 can be obtained.

For example, as above mentioned, by spraying the culture of bacterial biopolymer-producing microorganisms 200 through the mesh wire 300 it is possible to obtain a woven fabric 1 having regions that are contacted by the culture of biopolymer-producing microorganisms 200 and other regions that are not contacted by the sprayed culture of bacterial biopolymer-producing microorganisms 200. In this case, a discontinuous (i.e. interrupted) bacterial biopolymer layer 4 can be obtained, thus providing a composite fabric 10 having a discontinuous (i.e. interrupted) bacterial biopolymer layer 4; in other words, a woven fabric 1 with regions that are covered by the bacterial biopolymer layer 4, and other regions which are not covered by the bacterial biopolymer layer 4 can be obtained.

Specifically, the regions of the woven fabric 1 contacted by the culture of biopolymer-producing microorganisms 200 are those regions of the woven fabric 1 which are in correspondence of the mesh wire windows 302 when the culture of bacterial biopolymer-producing microorganisms 200 is sprayed onto the woven fabric 1; such regions, after the culturing of the microorganism on the woven fabric 1, result to be regions of the composite fabric 10 that are provided with the bacterial biopolymer layer 4.

On the contrary, where the woven fabric 1 is hidden by the mesh wire structure 301 when the culture of bacterial biopolymer-producing microorganisms 200 is sprayed onto the woven fabric 1, the culture of biopolymer-producing microorganisms 200 does not substantially contact the woven fabric 1 and, therefore, the bacterial biopolymer layer 4 is not produced, thus providing regions of the composite fabric 10 that are not provided with the bacterial biopolymer layer 4. The mesh wire 300 may be removed before dyeing once the bacterial cellulose is grown on the fabric, which is about 10 to 23 hours, e.g. 14-18 hours.

Figure 9:
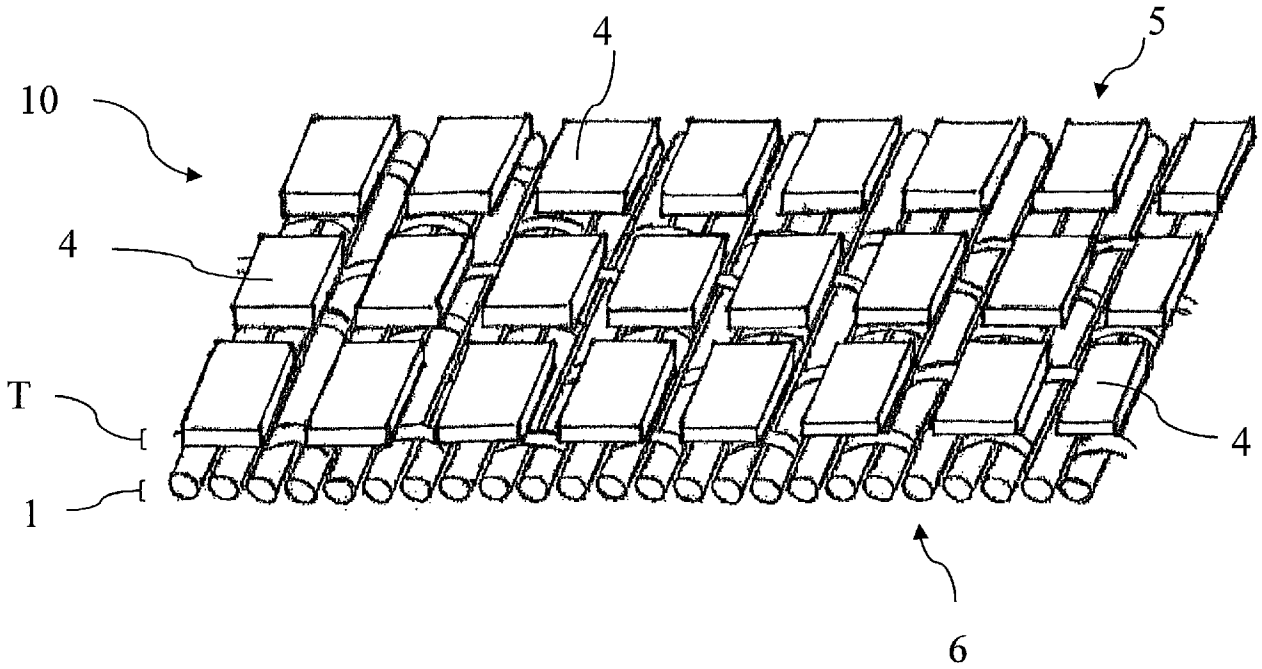
FIG. 9 is a perspective view of a portion of an exemplary composite fabric according to the invention, having a discontinuous bacterial biopolymer layer.

FIG. 9 is a perspective view of a portion of an exemplary composite fabric 10, having a discontinuous bacterial biopolymer layer 4. The exemplary composite fabric 10 of FIG. 9 is obtained by spraying a culture of biopolymer-producing microorganisms 200 through a mesh wire 300 on a woven fabric 1, and subsequently culturing the biopolymer-producing microorganisms directly on the woven fabric 1, without removing the mesh wire 300. The mesh wire 300 may be advantageously removed after the "growth" of the bacterial biopolymer layer 4 is completed to the desired degree, before the bacterial layer is removed at least in part from the fabric or the yarns.

The woven fabric 1 is thus coupled to a discontinuous bacterial biopolymer layer 4, providing a composite fabric 10. The exemplary embodiment of the composite fabric 10 of FIG. 9, comprises a woven fabric 1 coupled to a discontinuous bacterial biopolymer layer 4, on its front side 5.

The back side 6 of the woven fabric 1 is also indicated in FIG. 9. In this case, the back side 6 of the woven fabric 1 corresponds to the back side of the composite fabric 10.

In the embodiment of FIG. 9, the bacterial biopolymer layer 4 is schematically represented as a discontinuous uniform layer. Namely, bacterial biopolymer layer 4 of FIG. 9 is "discontinuous" because it covers the front side 5 of the woven fabric 1 with "interruptions", i.e. leaving regions that are not provided with the bacterial biopolymer layer 4. The bacterial biopolymer layer 4 of FIG. 9 is "uniform", because it maintains the same thickness T over its entire extension.

In embodiments of the invention, the bacterial biopolymer layer 4 is a discontinuous non-uniform layer, i.e. it is an interrupted layer, and has a thickness T which is variable throughout the extension of the bacterial biopolymer layer 4.

Figure 10:
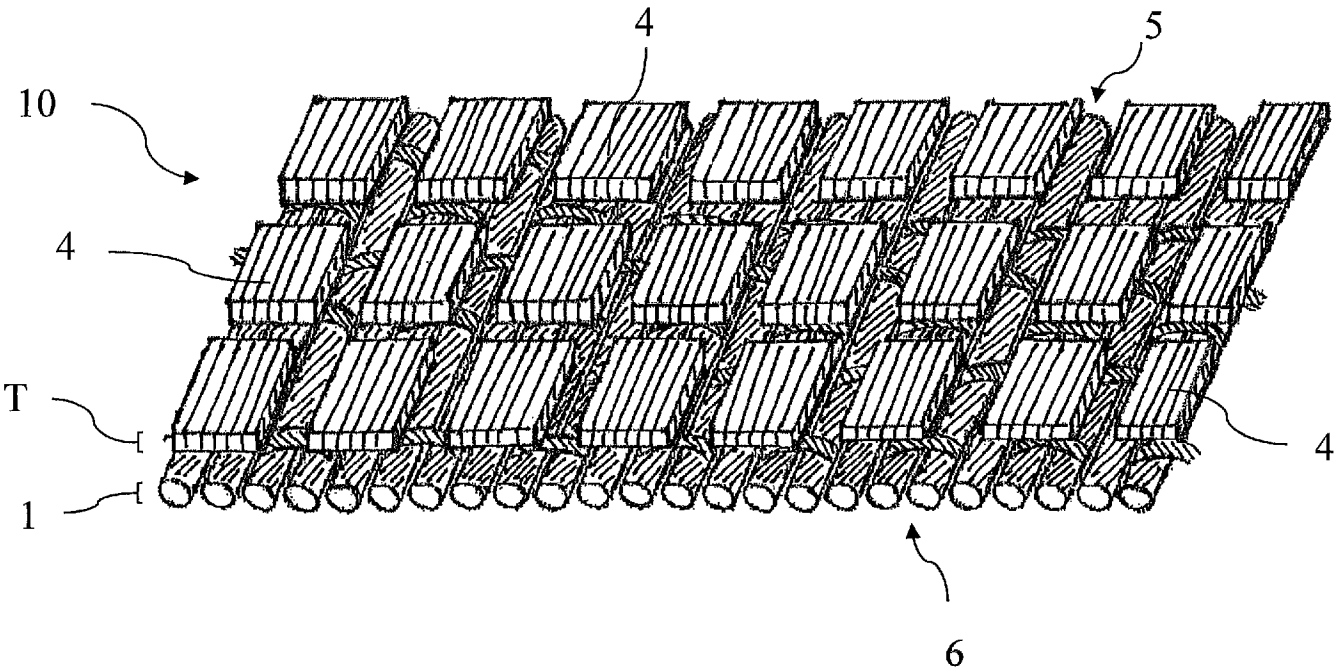
FIG. 10 is a perspective view of a portion of an exemplary composite fabric according to the invention, having a discontinuous bacterial biopolymer layer, after the dyeing process.

FIG. 9 shows an exemplary composite fabric 10 which is not dyed, i.e. which has not been subjected to a process of dyeing. FIG. 10 is a perspective view of a portion of an exemplary composite fabric 10, having a discontinuous uniform bacterial biopolymer layer 4. In particular, FIG. 10 shows the composite fabric 10 after dyeing. The exemplary embodiment of the composite fabric 10 of FIG. 10, comprises a woven fabric 1 provided with a discontinuous uniform bacterial biopolymer layer 4, having thickness T, on its front side 5.

The back side 6 of the woven fabric 1 is also indicated in FIG. 10. In this case, the back side 6 of the woven fabric 1 corresponds to the back side of the composite fabric 10.

According to the embodiment of FIG. 10, the bacterial biopolymer layer 4 is a discontinuous bacterial biopolymer layer 4, and the regions of the woven fabric 1 which are not coupled with (namely "not covered by") the bacterial biopolymer layer 4 are dyed, as well as the bacterial biopolymer layer 4.

Figure 11:
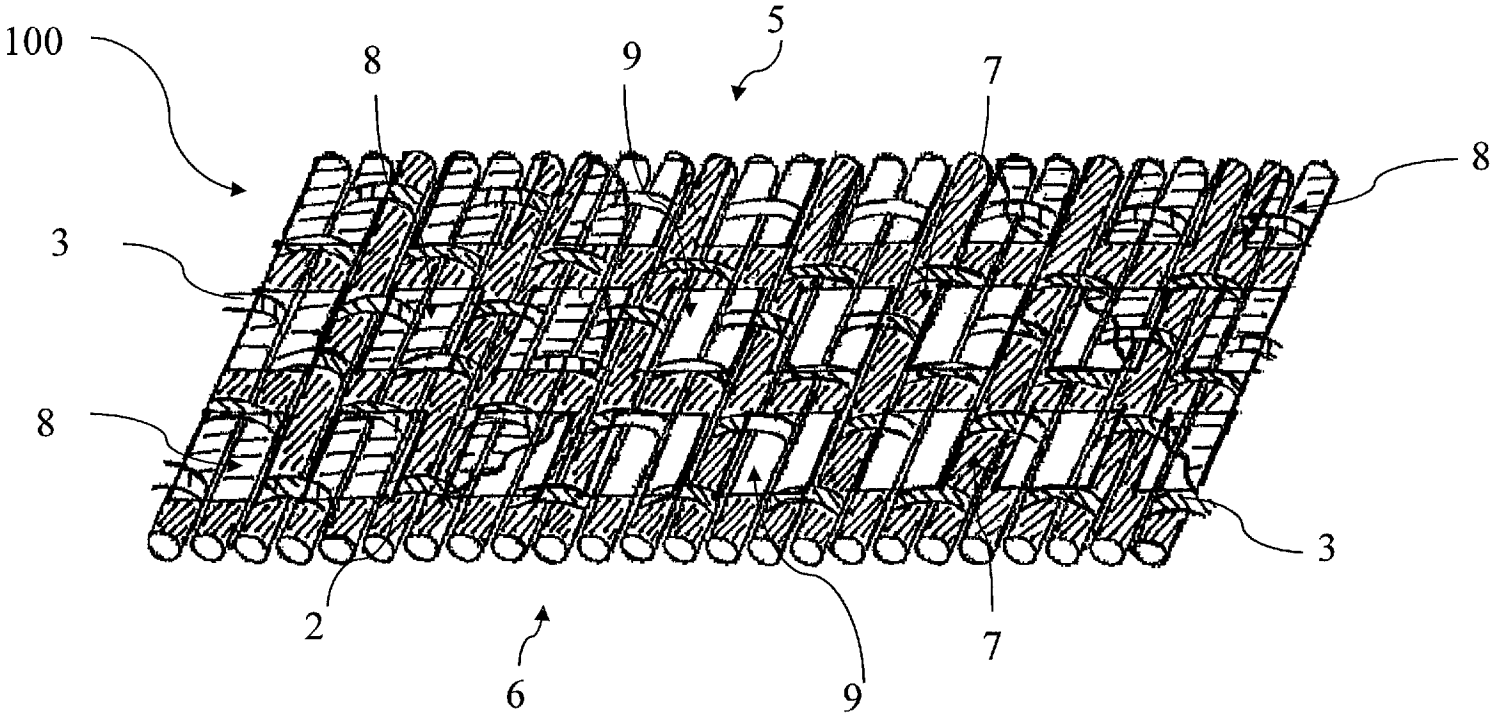
FIG. 11 is a perspective view of an exemplary embodiment of the treated fabric as obtainable by the process of the invention.

FIG. 11 shows a perspective views of an exemplary embodiment of a treated fabric 100 as obtainable by the process of the invention, i.e. after that at least part of the bacterial biopolymer layer 4 is removed from the composite fabric 10. FIG. 11 shows a treated fabric 100, having warp yarns 2 and weft yarns 3 and having a front side 5 and a back side 6.

FIG. 11 shows an embodiment wherein the bacterial biopolymer layer 4 has been completely removed from the woven fabric 1, and that is obtainable when the bacterial biopolymer layer 4 of the composite fabric 10 is a discontinuous layer, such as, for example, in the composite fabric 10 illustrated in FIG. 10 and FIG. 9.

The treated fabric 100 of FIG. 11 presents, on its front side 5, first regions 7 that are intensely colored, second regions 8 that are slightly colored (i.e., dyed with a lighter shade of color than the first regions 7), and third regions 9 that are substantially not colored, i.e. not dyed.

FIG. 11 shows an embodiment of the treated fabric 100 wherein first regions 7 correspond to those regions that were not coupled with the bacterial biopolymer layer 4, i.e. those regions where the thickness T of the bacterial biopolymer layer 4 was zero. The treated fabric 100 of FIG. 11 further presents second regions 8 which are colored with a lighter shade of dye than the first regions 7, and third regions 9 which are substantially not dyed.

Third regions 9 are obtained, for example, when the dye that is applied to the composite fabric 10 is completely absorbed by the bacterial biopolymer layer 4 and, therefore, does not reach the woven fabric 1, which remains undyed.

Second regions 8 are obtained, for example, when part of the dye that is applied to the composite fabric 10 reaches the woven fabric 1, thus providing the treated fabric 100 with second regions 8 which are colored with a lighter shade of dye than the first regions 7, when the bacterial biopolymer layer 4 is removed. First regions 7 are obtained, for example, when the majority of the dye that is applied to the composite fabric 10 reaches the woven fabric 1.

FIG. 11 is a schematic representation of a treated fabric 100 according to the invention; in fact, the treated fabric 100 of the invention have a shaded appearance, i.e. the treated fabric 100 presents numerous different color shades, due to the different penetration of the dye, throughout the bacterial biopolymer layer 4, namely through the thickness T of the bacterial biopolymer layer 4.

As above discussed, this is particularly true in the embodiments of the invention, where the bacterial biopolymer layer 4 has a thickness T that is not the same throughout the extension of the bacterial biopolymer layer 4, i.e. thickness T can assume different values (e.g. T1, T2, T3) in different regions of the bacterial biopolymer layer 4, i.e. the bacterial biopolymer layer 4 is non-uniform.

The number of the shades of color is further increased in those embodiments wherein the bacterial biopolymer layer 4 is discontinuous. In fact, the dye uptake of the composite fabric 10 is substantially determined by the thickness T of the bacterial biopolymer layer 4. In particular, it has been observed that, the higher is the thickness T, the higher is the dye uptake. In other words, when a composite fabric 10 presents a bacterial biopolymer layer 4 having variable thickness T, different amounts of dye reach the surface (i.e., for example, the front side 5) of the woven fabric 1.

For example, if the thickness T of the bacterial biopolymer layer 4 is high, a little, or none, dye reaches the surface (i.e., for example, the front side 5) of the woven fabric 1, thus providing the treated fabric 100 with second regions 8 that are slightly colored and/or third regions 9 that are substantially not colored, i.e. not dyed.

On the contrary, for example, if the thickness T of the bacterial biopolymer layer 4 is low, or the bacterial biopolymer layer 4 is absent (e.g. when the bacterial biopolymer layer 4 is discontinuous) a great amount of dye reaches the surface (i.e., for example, the front side 5) of the woven fabric 1, thus providing the treated fabric 100 with first regions 7, that are intensely colored.

EXAMPLES

The following examples illustrate a process for the production of a treated fabric according to various embodiments of the disclosure.

The following examples are to be interpreted as merely illustrative and they do not limit the scope of the invention.

Example 1

25 ml of a culture of *Gluconacetobacter hansenii* having a concentration of $2\times10^4$ cells/ml, is sprayed culture on the front side of a sample woven fabric according to the invention. The culture used is a culture of *Gluconacetobacter hansenii*, in in Hestrin-Schramm (HS) medium containing 2% (w/v) glucose, 0.5% (w/v) peptone, 0.5% (w/v) yeast extract, 0.27% (w/v) Na2HPO4 and 1.15 g/L citric acid.

Illustrative examples of woven fabrics according to the invention, which were used according to the present "Examples" are the following:

1. "Rigid"—12 oz 100% cotton:

Warp yarns are Ne 7/1-10/1

Weft yarns are Ne 8/1-10/1

Warp density of the fabric is 25-28 threads/cm

Weft density of the fabric is 17-20 picks/cm

The weight of the woven fabric is 640-670 g/m

The front side of the woven fabric has a surface density of 407-423 g/m$^2$

Materials that can be used for the woven fabric, in particular for warp yarns, are cotton, cotton and other staple fibers blend, or staple fibers apart from cotton (CottoniTencel, Cotton/Modal, Cotton/PES, Cotton/Bamboo, 100% PES, 100% Tencel, Modal or Tencel/Modal blends).

2. "Comfort"—12 oz cotton/elastane (18%-25% elasticity):

Warp yarns are Ne 7/1-10/1

Weft yarns are Ne 10/1-12/1

Warp density of the fabric is 27-31 threads/cm

Weft density of the fabric is 17-21 picks/cm

The weight of the woven fabric is 500-550 g/m

The front side of the woven fabric has a surface density of 407-423 g/m$^2$

Materials that can be used for the woven fabric, in particular for warp yarns, are cotton, cotton and other staple fibers blend, or staple fibers apart from cotton (Cotton/Tencel, Cotton/Modal, Cotton/PES, Cotton/Bamboo, 100% PES, 100% Tencel, Modal or Tencel/Modal blends).

3. "Super stretch"—12 oz cotton/elastane (40%-65% elasticity):

Warp yarns are Ne 9/1-12/1

Weft yarns are Ne 15/1-18/1

Warp density of the fabric is 29-32 threads/cm

Weft density of the fabric is 20-24 picks/cm

The weight of the woven fabric is 464-490 g/m

The front side of the woven fabric has a surface density of 407-423 g/m$^2$

Materials that can be used for the woven fabric, in particular for warp yarns, are cotton, cotton and other staple fibers blend, or staple fibers apart from cotton (Cotton/Tencel, Cotton/Modal, Cotton/PES, Cotton/Bamboo, 100% PES, 100% Tencel, Modal or Tencel/Modal blends).

Example 2

After the application (spraying) of the bacterial culture of Example 1 on the woven fabric, the woven fabric is incubated for 16 hours, at temperature 28° C. After 16 hours, at temperature 28° C., a layer of bacterial cellulose having a thickness ranging from 0.5 mm to 1 mm, with an average value of 0.75 mm is obtained on the front side of the woven fabric, i.e. a composite fabric is obtained.

Example 3

After the bacterial cellulose layer growth is completed, the composite fabric obtained in Example 2 is washed with 0.1 M NaOH at 80° C. temperature to remove the residual bacteria and all the impurities coming from the growth medium including the bacteria, and in NaOCl, for 20 minutes to remove the residual bacteria from the composite fabric.

After the removal of residual bacteria and all the impurities coming from the growth medium including the bacteria, the composite fabric is print-dyed, with a dye selected from indigo, pigments, reactive and sulphur dyes. The composite fabric may be print-dyed with indigo on its front side, i.e. on the side wherein the bacterial cellulose layer is present.

Alternatively, the composite fabric may be VAT dyed with conventional indigo dyeing (i.e. on both sides of the fabric).

Example 4

The dyed composite fabric obtained in Example 3 is finished through one or more finishing techniques.

For example, the dyed composite obtained in Example 3 may be rinsed with water 20 minutes at 40° C. Additionally or alternatively, the dyed composite fabric obtained in Example 3 may be or stone washed (i.e. washed in the presence of pumice stone) 20 minutes at 40° C., followed by enzyme wash for 10 minutes at 50° C. to remove small hair (pilling) created by the stone wash.

Additionally or alternatively, the dyed composite obtained in Example 3 may undergo stone bleaching, for 20 minutes at 40° C. Additionally or alternatively, the dyed composite fabric obtained in Example 3 may undergo laser treatments. One or more of the above-mentioned techniques are used to remove the bacterial cellulose layer, thus obtaining a treated fabric according to the invention.

As used herein, "exemplary" means "as an example" and therefore an "exemplary embodiment" should not be considered to refer to a preferred or superior embodiment, but rather to "an example." As such, an "exemplary embodiment" is used to mean "as one example, an embodiment of the disclosure."

Although the invention has been described in terms of various embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A process for producing a treated fabric, said process comprising:

providing yarns including at least a plurality of warp yarns and at least a plurality of weft yarns;

weaving said at least a plurality of warp yarns with said at least a plurality of weft yarns to provide a woven fabric having a front side and a back side;

providing at least a layer of at least one bacterial biopolymer on said yarns or on at least part of at least one of said sides of said woven fabric to provide a composite fabric;

dyeing at least part of said composite fabric, whereby at least part of said yarns are dyed together with said biopolymer layer; and removing at least part of said layer of at least one bacterial biopolymer from said composite fabric to obtain a treated fabric.

2. The process according to claim 1, wherein thickness of said at least a layer of at least one bacterial biopolymer is non-uniform throughout said layer of at least one bacterial biopolymer.

3. The process according to claim 1, wherein at least part of said at least a layer of at least one bacterial biopolymer is a discontinuous layer.

4. The process according to claim 1, wherein said bacterial biopolymer is selected from the group consisting of bacterial cellulose, a further sugar-based biopolymer, bacterial collagen, a further amino acid-based biopolymer, and a mixture thereof.

5. The process according to claim 1, wherein said providing at least a layer of at least one bacterial biopolymer, is carried out after said weaving by producing said layer of at least one bacterial biopolymer on the woven fabric or before said weaving by producing said bacterial biopolymer layer on said yarns before weaving said woven fabric.

6. The process according to claim 1, wherein said woven fabric is coupled to a separately produced bacterial biopolymer layer.

7. The process according to claim 5, wherein said providing at least a layer of at least one bacterial biopolymer comprises contacting at least part of said woven fabric or at least part of said yarns with a culture of bacterial biopolymer-producing microorganisms to produce said bacterial biopolymer, and culturing said bacterial biopolymer-producing microorganisms.

8. The process according to claim 7, wherein said culture of bacterial biopolymer-producing microorganisms is sprayed on at least part of the front side of said woven fabric.

9. The process according to claim 8, wherein said culture of bacterial biopolymer-producing microorganisms is sprayed on said at least part of said woven fabric through a mesh wire.

10. The process according to claim 7, wherein said contacting at least part of said woven fabric or at least part of said yarns with a culture of microorganisms comprises dipping said at least part of said woven fabric or at least part of said yarns, into said culture of bacterial biopolymer-producing microorganisms.

11. The process according to claim 7, wherein said bacterial biopolymer-producing microorganisms comprise at least one of bacterial biopolymer-producing bacteria, bacterial biopolymer-producing algae, and a mixture thereof, wherein said bacterial biopolymer-producing bacteria are selected from the group consisting of *Gluconacetobacter, Aerobacter, Acetobacter, Achromobacter, Agrobacterium, Azotobacter, Salmonella, Alcaligenes, Pseudomonas, Rhizobium, Sarcina, and Streptoccoccus, Bacillus* genus, and mixtures thereof, and wherein said bacterial biopolymer-producing algae are selected from the group consisting of Phaeophyta, Rhodophyta, Chrysophyta, and mixture thereof.

12. The process according to claim 1, wherein said woven fabric comprises at least one of said plurality of warp yarns and said plurality of weft yarns forming an additional layer of said woven fabric including loop portions on at least one of said sides of said woven fabric and wherein at least part of said additional layer is disposed within said bacterial biopolymer layer.

13. The process according to claim 1, wherein at least one of said warp yarns and said weft yarns is selected from the group consisting of natural yarns, synthetic yarns and mixed yarns, wherein said natural yarns comprise natural fibers selected from the group consisting of cotton, wool, flax, kenaf, ramie, hemp, and mixtures thereof, wherein said synthetic yarns comprise synthetic fibers selected the group consisting of from polyester, rayon, nylon, lycra and mixtures thereof, and wherein said mixed yarns comprise both natural fibers and synthetic fibers.

14. The process according to claim 1, wherein said woven fabric is a denim fabric.

15. The process according to claim 1, wherein said dyeing comprises one of print-dyeing, indigo dyeing, and dipping said composite fabric into an indigo dye bath.

16. The process according to claim 1, wherein said removing comprises at least one of laundry washing and abrading at least part of said at least one bacterial biopolymer layer from said composite fabric.

17. A treated fabric formed according to the process of claim 1.

18. The treated fabric according to claim 17, wherein said treated fabric includes part of said layer of at least one bacterial biopolymer.

19. A garment comprising the treated fabric of claim 17.

20. A garment comprising the treated fabric of claim 18.

21. The garment according to claim 20, wherein the front side of said treated fabric is disposed externally and forms a visible side of the garment when the garment is worn, and wherein the back side of said treated fabric is disposed internally and forms a non-visible side of the garment when the garment is worn.

* * * * *